US005931090A

United States Patent [19]

Ohkawa

[11] Patent Number: 5,931,090

[45] Date of Patent: Aug. 3, 1999

[54] PRINTER

[75] Inventor: Eiji Ohkawa, Watari-gun, Japan

[73] Assignee: Tohoku Ricoh Co., Ltd., Miyagi-Ken, Japan

[21] Appl. No.: 09/042,615

[22] Filed: Mar. 17, 1998

[30] Foreign Application Priority Data

Jun. 9, 1997 [JP] Japan ..... 9-151365
Nov. 14, 1997 [JP] Japan ..... 9-313651

[51] Int. Cl.[6] ..... B41L 13/04

[52] U.S. Cl. ..... 101/118; 101/119; 271/3.15; 271/226; 271/314

[58] Field of Search ..... 101/116, 117, 101/118, 119, 120; 271/3.15, 226, 314

[56] References Cited

U.S. PATENT DOCUMENTS

| | | | |
|---|---|---|---|
| 3,283,710 | 11/1966 | Zahradnik et al. | 101/118 |
| 4,519,700 | 5/1985 | Barker | 271/226 |
| 4,911,069 | 3/1990 | Hayama et al. . | |
| 4,919,047 | 4/1990 | Inouye et al. | 101/175 |
| 5,165,338 | 11/1992 | Okazaki et al. | 101/118 |
| 5,373,785 | 12/1994 | Yamamoto | 101/116 |
| 5,415,387 | 5/1995 | Suzuki . | |
| 5,419,243 | 5/1995 | Hanzawa et al. | 101/116 |
| 5,438,347 | 8/1995 | Shishido et al. | 101/107 |
| 5,483,878 | 1/1996 | Hanzawa | 101/118 |

FOREIGN PATENT DOCUMENTS

| | | |
|---|---|---|
| 5-305707 | 11/1993 | Japan . |
| 5-330225 | 12/1993 | Japan . |
| 6-20620 | 6/1994 | Japan . |
| 6-247586 | 9/1994 | Japan . |
| 8-332769 | 12/1996 | Japan . |
| 9-1914 | 1/1997 | Japan . |
| 9-216448 | 8/1997 | Japan . |

*Primary Examiner*—Eugene Eickholt
*Attorney, Agent, or Firm*—Oblon, Spivak, McClelland, Maier & Neustadt, P.C.

[57] ABSTRACT

A printer of the type wrapping a master around a print drum and pressing a sheet against the master with the print drum or a press drum is disclosed. A pulse encoder is mounted on the press drum for sensing changes in the rotation speed of the press drum, so that a timing for feeding the leading edge of the sheet toward a clamper can be controlled. The clamper is capable of surely clamping the leading edge of a sheet and preventing it from rolling up. The sheet can be fed stably and reliably and can therefore be brought into accurate registration.

7 Claims, 14 Drawing Sheets

PRINTER

BACKGROUND OF THE INVENTION

The present invention relates to a printer and, more particularly, to a stencil printer of the type wrapping a master around a print drum and pressing a sheet against the master with the print drum or a press drum.

Various kinds of sheet feeding devices have heretofore been proposed for use in a printer of the type described. One of them uses a sector gear for feeding a sheet from the top of a stack loaded on a sheet tray to a gap between a print drum and a press roller. The problem with the conventional sector gear scheme is that it cannot maintain the positional accuracy or registration accuaracy in the direction of sheet transport, an needs a main motor whose output power is great enough to withstand a heavy load.

Another conventional sheet feeding device includes a press drum having substantially the same outside diameter as the print drum in place of the press roller. The press drum scheme, however, has a problem that the timing for causing a registration roller pair to convey a sheet toward a sheet clamper is not accurate. As a result, the sheet is caused to roll up. Another problem is that the sheet clamper cannot surely clamp the leading edge of the sheet.

Technologies relating to the present invention are also disclosed in, e.g., Japanese Patent Laid-Open Publication Nos. 5-330225, 8-332769, 9-1914, 5-305707 and 6-247586, Japanese Utility Model Publication No. 6-20620, and U.S. Pat. Nos. 5,415,387 and 4,911,069.

SUMMARY OF THE INVENTION

It is therefore an object of the present invention to provide a printer capable of insuring a stable and reliable sheet feed timing.

It is another object of the present invention to provide an inexpensive printer operable with a main motor outputting a minimum of power.

It is a further object of the present invention to provide a printer capable of simplifying a program assigned to a controller and promoting rapid processing to thereby provide feedback control with an accurate following ability.

A printer for printing an image on a sheet by pressing the sheet against a master of the present invention includes a print drum for wrapping the master therearound. A press drum has substantially the same outside diameter as the print drum for pressing the sheet relatively against the print drum. The press drum includes a sheet clamper for clamping the leading edge of the sheet. A pulse encoder senses at least a change in the rotation speed of the press drum to thereby allow the timing for feeding the leading edge of the sheet toward the sheet clamper to be controlled.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENT

Figure 1:
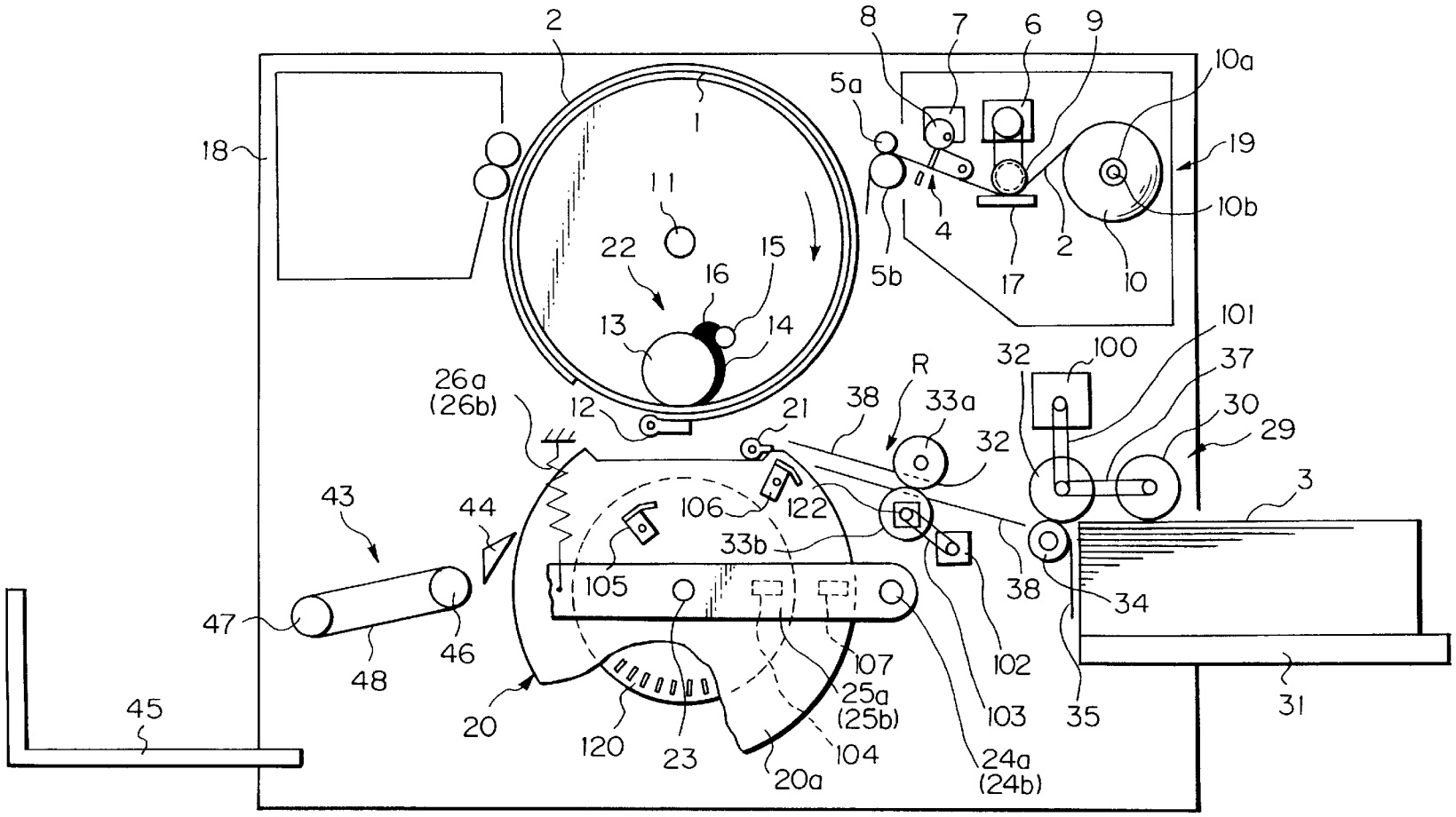
FIG. 1 is a front view showing a stencil printer embodying the present invention.

To better understand the present invention, brief reference will be made to a conventional stencil printer, shown in FIG. 13. As shown, the stencil printer includes a sheet feeding device 29'. The sheet feeding device 29' includes an elevatable sheet tray 31 loaded with a stack of sheets 3. A pick-up roller 30 and a feed roller 32 are journalled to opposite side walls not shown. A reverse roller 34 is pressed against the feed roller 32 in order to prevent two or more of the sheets 3 from being fed together. A pair of registration rollers 33*a* and 33*b* drive the leading edge of the sheet 3 fed from the sheet tray 31 to a gap between a print drum 1 and a press roller or pressing means 40 at a preselected timing. The print drum 1 is implemented as a porous hollow cylinder. A pair of guides 38' guide the leading edge of the sheet 3 toward the gap between the print drum 1 and the press roller 40 via the registration rollers 33*a* and 33*b*.

The sheet tray 31 is elevatable such that the sheet 3 on the top of the stack remains in contact with the pick-up roller 30 under a preselected pressure which allows the sheet 3 to be paid out A front wall 35 stands upright at the left end of the tray 31. The sheets 3 are positioned on the tray 31 with their leading edges abutting against the front wall 35.

The feed roller 32 is rotated clockwise by a cam, not shown, rotatable in synchronism with the print drum 1, a sector gear having a cam follower contacting the cam, and a feed roller gear meshing with the sector gear and having a one-way clutch built therein. An endless belt 37 connects the pick-up roller 30 and feed roller 32 and transmits the rotation of the latter to the former.

Figure 18:
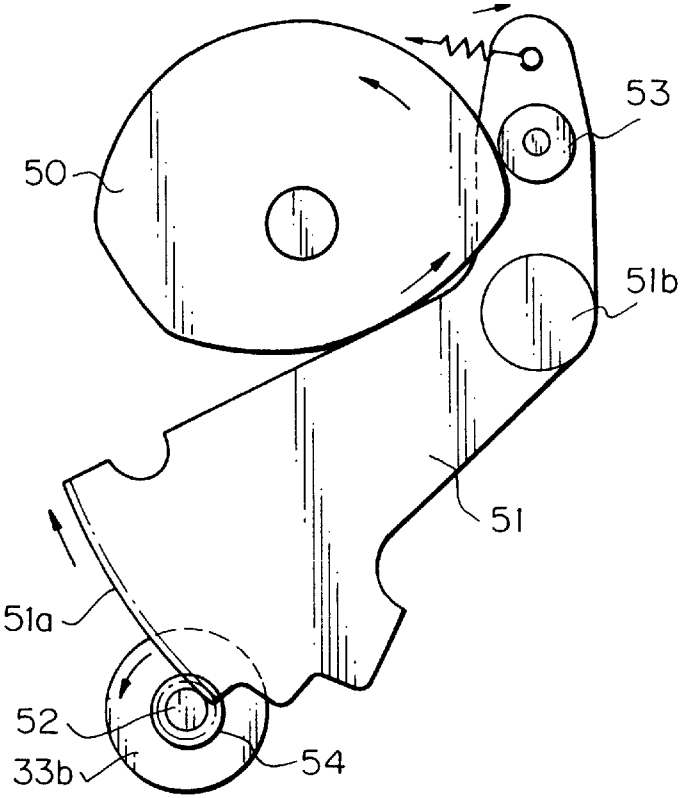
Fig. 18 PRIOR ART
FIGS. 17 and 18 are front views showing a specific configuration of a drive mechanism included in the conventional sheet feeding device, and the operation of the drive mechanism.
Figure 17:
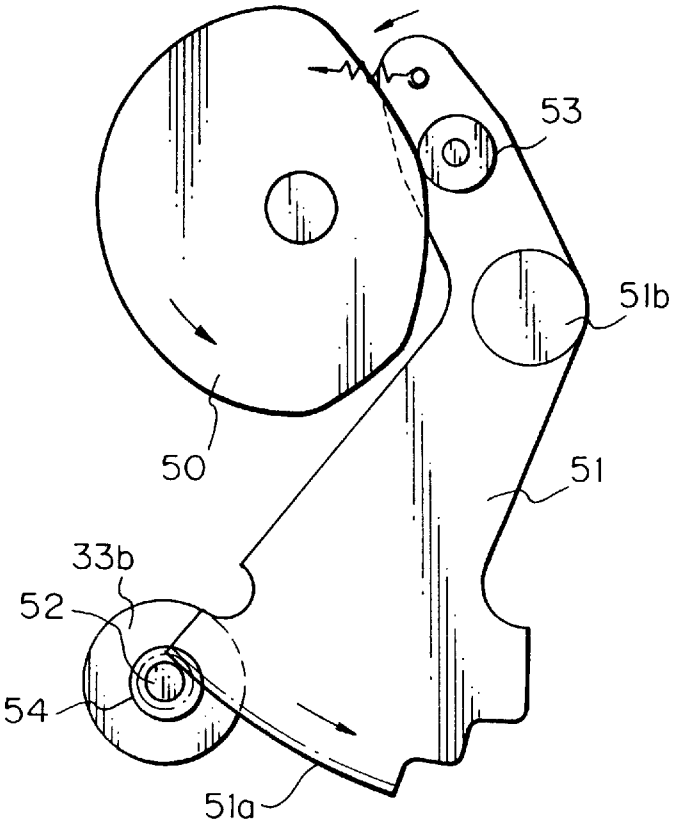
Fig. 17 PRIOR ART

The registration rollers 33*a* and 33*b* are journalled to the side walls at a position downstream of the reverse roller 34 in a direction X in which the sheets 3 arm conveyed. The registration rollers 33*a* and 33*b* are driven in the same manner as the feed roller 32. Specifically, as shown in FIGS. 17 and 18, the lower registration roller 33*b* is rotated counterclockwise by a cam 50, a sector 51 rotatable about a shaft 51*b*, a cam follower 53 positioned on one end of the sector 51 and engaged with the cam 50, a sector gear 51*a* formed on the other end of the sector 51, and a registration roller gear 54 meshing with the sector gear 51*a* and having a one-way clutch 52 thereinside. The registration rollers 33*a* and 33*b* are caused to convey the sheet 3 at a speed equal to the peripheral speed of the print drum 1. The sheet feed system using the above members including the sector gear 51*a* is the sector gear scheme stated earlier.

Figure 13:
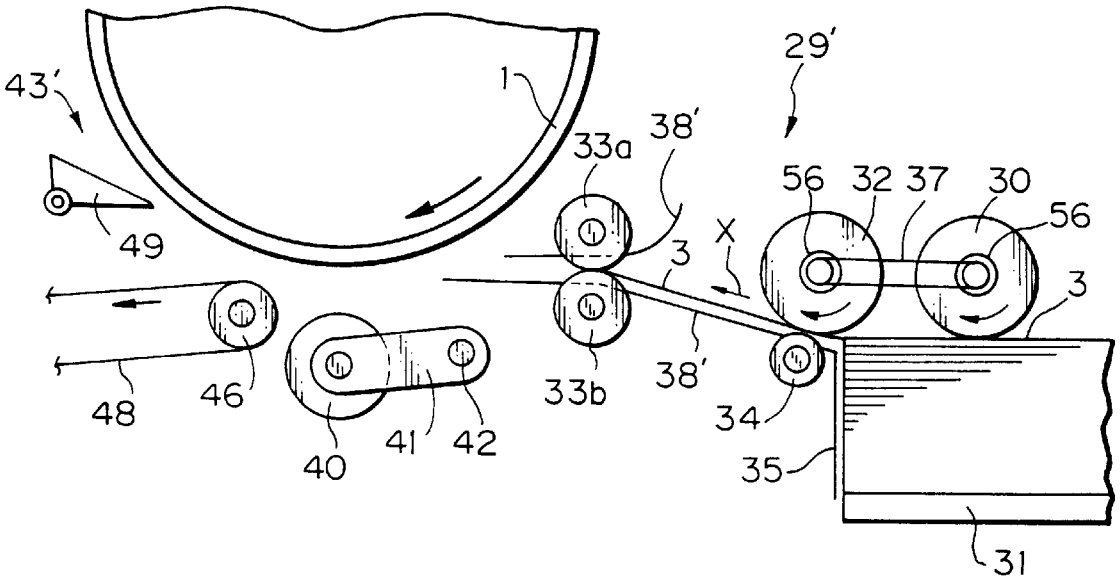
Fig. 13 PRIOR ART
FIG. 13 is a front view showing the construction of a sheet feeding device included in a conventional stencil printer, and how a feed roller feeds a sheet at the start-up of operation.
Figure 14:
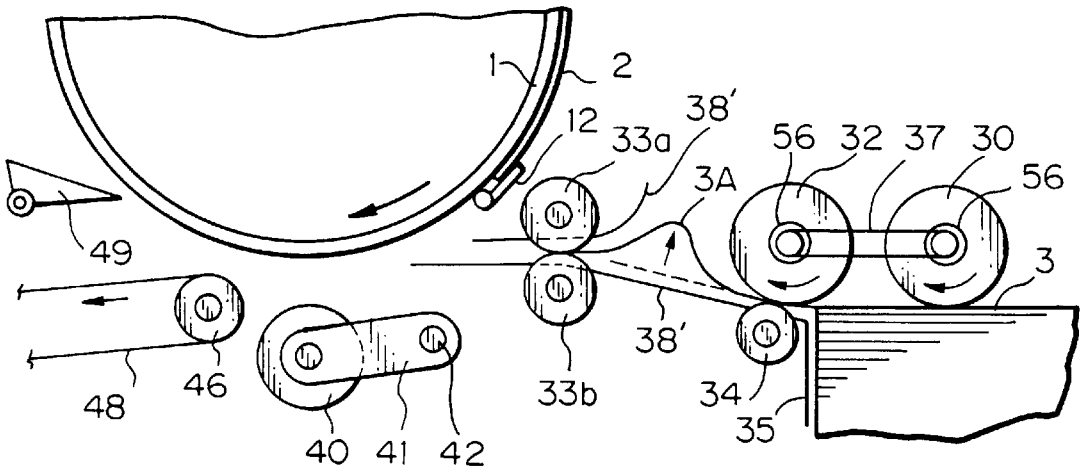
Fig. 14 PRIOR ART
FIG. 14 shows how the conventional sheet feeding device causes the sheet to form a slack between the feed roller and a registration roller.

As shown in FIGS. 13 and 14, the press roller 40 is positioned below the print drum 1 and movable into and out of contact with the drum 1 with the intermediary of a master 2. The press roller 40 is rotatably supported by the one end of a pair of roller arms 41 (only one is visible). The other end of each roller arm 41 is fixed to a shaft 42 which is journalled to the side walls mentioned previously. A cam or similar drive member, not shown, is mounted on one end of the shaft 42 and causes the free ends of the roller arms 41 to move in matching relation to the rotation of the print drum 1.

A sheet discharging device 43' is arranged at the left-hand side and below the print drum 1. The sheet discharging device 43' includes a peeler 49, a conveyor belt 48, and a roller 46 over which the belt 48 is passed The peeler 49 is rotatable so as to peel off the leading edge of the sheet 3 adhered to the master 2 due to the adhesion of ink. The belt 48 and roller 46 cooperate to convey the sheet or printing 3 separated from the master 2 by the peeler 49 to a printing tray, not shown, while retaining it on the belt 48.

Figure 15:
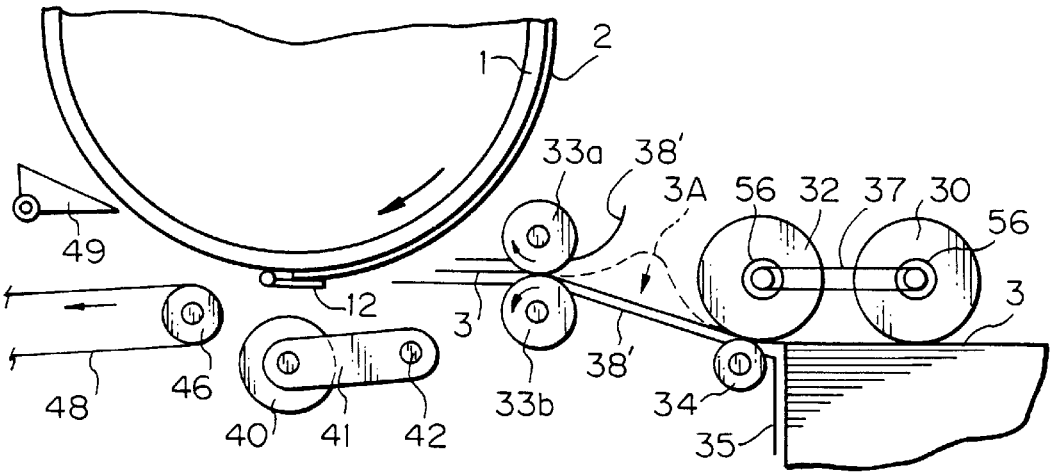
Fig. 15 PRIOR ART
FIG. 15 demonstrates how the registration roller of the conventional stencil printer conveys the sheet just after it has been driven.
Figure 16:
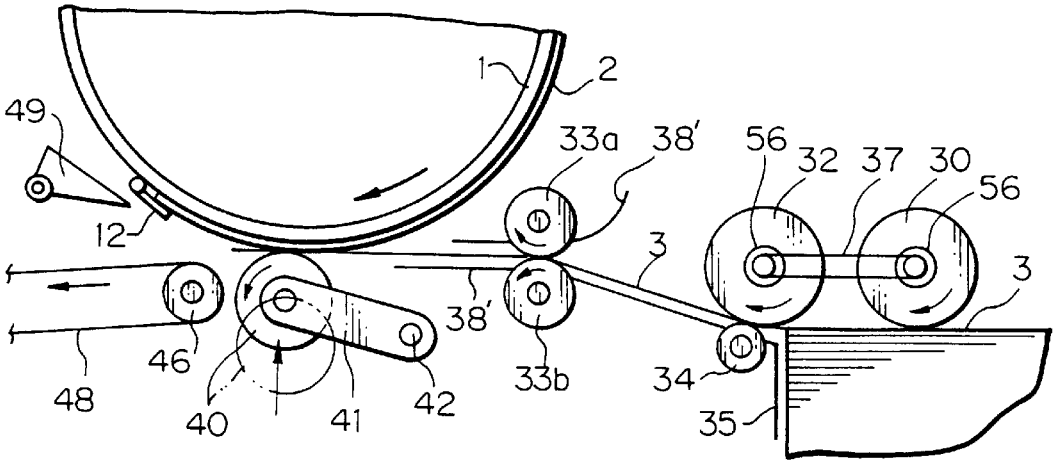
Fig. 16 PRIOR ART
FIG. 16 is a front view demonstrating the transport of the sheet occurring in the conventional stencil printer at the initial stage of printing operation.

How the sheet 3 is conveyed in the above arrangement will be described. As shown in FIG. 13, while the pick-up roller 30 pays out the top sheet 3 from the sheet tray 31, the feed roller 32 and reverse roller 34 separate the top sheet 3 from the underlying shoots 3. As a result, only the top sheet 3 is fed toward the registration rollers 33*a* and 33*b*. The leading edge of the sheet 3 abuts against the nip between the registration rollers 33*a* and 33*b*. As own in FIG. 14, the sheet 3 forms a curved slack 3A as the conveyance proceeds. At this time, the rotation of the pick-up roller 30 and feed roller 32 is interrupted. Subsequently, the cam 50, FIGS. 17 and 18, causes the registration rollers 33*a* and 33*b* to start rotating at a preselected timing. As a result, the slack 3A of the sheet 3 disappears, as viewed in FIG. 15. While the pickup up roller 30 and feed roller 32 rotate by following the movement of the sheet 3 via one-way clutches 56, the sheet 3 is conveyed to the gap between the print drum 1 and the press roller 40. As shown in FIG. 16, as soon as the leading edge of the sheet 3 is brought to the gap between the print drum 1 and the press roller 40, the roller 40 is lifted so as to press the sheet 3 against the drum 1. In this condition, an image is printed on the sheet 3 by a procedure well known in the art.

Another conventional sheet feeding device includes a press drum having substantially the same outside diameter as the print drum in place of the press roller. The press drum is rotatable at substantially the same peripheral speed as the print drum, but in the opposite direction to the print drum, while clamping the leading edge of a sheet thereon. The press drum therefore forcibly separates the leading edge of the sheet, or printing, from the print drum. With this kind of press drum, it is possible to obviate an occurrence that the leading edge of the sheet is not peeled off by a peeler, causing the sheet to roll up and jam. It is also possible to reduce noise and to enhance accurate positioning of an image on the sheet in the direction of sheet transport (registration accuracy).

The problems with the conventional sector gear scheme described above are as follows. While the sheet 3 is conveyed from the position shown in FIG. 15 to the position shown in FIG. 16, the pick-up roller 30 and feed roller 32 each exerts a load on the sheet 3 although simply following the movement of the sheet 3. In addition, because the reverse roller 34 does not rotate, it also exert a load on the sheet 3. As a result, the sheet 3 slips at the nip between the registration rollers 33*a* and 33*b* because the leading edge of the sheet 3 is free.

This towers the positional accuracy or registration accuracy of the sheet 3 in the direction of street transport X.

As shown in FIG. 13, a spring, not shown, constantly biases the registration rollers 33*a* and 33*b* in order to stop the leading edge of the sheet 3 at the nip between the rollers 33*a* and 33*b* for a moment. In addition, to maintain the rollers 33 and 33*b* unmovable until the arrival of the next sheet 3, brake is applied to the mechanism for driving the lower roller or drive roller 33*b*. This allows the rollers 33*a* and 33*b* to stop rotating just after the reciprocating movement of the sector gear 51*a*. However, because the cam 50 for moving the sector gear 51*a* is driven by a main motor associated with the print drum 1, the brake applied to the rollers 33*a* and 33*b* increases the load on the main motor. The main motor is therefore required to output great power.

On the other hand, the press drum scheme is not practicable without resorting to a drive transmission system between the print drum and the press drum and involving a top-down adjusting mechanism made up of a number of parts, as taught in, e.g., Japanase Patent Laid-Open Publication No. 9-216448. This, coupled with the fact that the above drive transmission system has a substantial length to a main motor, disturbs the timing for the sheet to be driven from a registration roller toward a sheet clamper provided on the press drum, lessening the effect of the press drum scheme. The disturbance is ascribable to backlash particular to a gear train included in the top-down adjusting mechanism and the slackening or stretching of a timing belt. As a result, the sheet is caused to roll up.

To solve the above problems, Japanese Patent Application Nos. 9-145518 and 9-310716 each teaches a technology relating to the sheet feed control of a printer using the press drum scheme. This technology will be briefly described with reference to FIGS. 1, 3 and 5. As shown, an interrupter 106 and a photosensor 107 are mounted on a press drum 20 and serve as timing sensing means for causing the leading edge of the sheet 3 to be fed toward the clamper 21 of the press drum 20 at a preselected timing. The output of the photosensor 107 is sent to a controller or registration roller drive control means 110. In response, the controller 110 drives a stepping motor 102 assigned to the lower registration roller such that the sheet 3 is conveyed in synchronism with the angular position of the clamper 21. This arrangement is similar to the arrangement of FIGS. 1, 3 and 5 except that the encoder 120, encoder sensor 121 and electromagnetic clutch 122 are absent, and that the controller 110 is substituted for the controller 111.

Even the above press drum type arrangement has the following problem which will be described with reference to FIGS. 10 and 11. The press drum 20 is pressed against the print drum 1 by the previously stated driveline every time a sheet arrives thereat Therefore, when the sheet 3 is fed from the registration rollers 33*a* and 33*b*, the load and therefore speed of the press drum 20 varies noticeably until the drum 20 has been pressed against the print drum 1. The leading edge of the sheet 3 is clamped by the clamper 21 under such a condition. That is, the peripheral speed of the press drum 20 varies continuously. It follows that with the sheet feed control using the output of the photosensor 107, it is difficult to allow the clamper 21 to surely clamp the leading edge of the sheet 3.

A preferred embodiment of the printer in accordance with the present invention and a modification thereof will be described hereinafter. In the embodiment and modification thereof, structural elements identical in function or configuration are designated by like reference numerals, and a detailed description thereof will not be made as far as possible in order to avoid redundancy. As for members provided in pairs, only one of them will be described except when distinction is necessary in order to simplify the description.

Referring to FIG. 1, a printer embodying the present invention is shown and implemented as a stencil printer. As shown, the printer includes a hollow cylindrical print drum 1 for wrapping a perforated stencil or master 2 therearound. A master making device 19 is positioned at the right-band side of the print drum 1, as viewed in FIG. 1, in order to make a master by perforating, or cutting, the stencil 2. An ink feeding device 22 is arranged in the print drum 1 for feeding ink to the mater 2 wrapped around the drum 1. A press drum 20 is positioned below the print drum 1 in order to press a sheet 3 against the master 2 wrapped around the drum 1. For this purpose, the press drum 20 is provided with a sheet clamper or clamping means 21 for clamping the leading edge of the sheet 3 conveyed thereto. A sheet feeding device 29 is located at the right-hand side of the press drum 20, as viewed in FIG. 1, in order to feed the show 3 toward the sheet clamper 21. A sheet discharging device 43 is aged at the left-hand side of the press drum 20.

Figure 2:
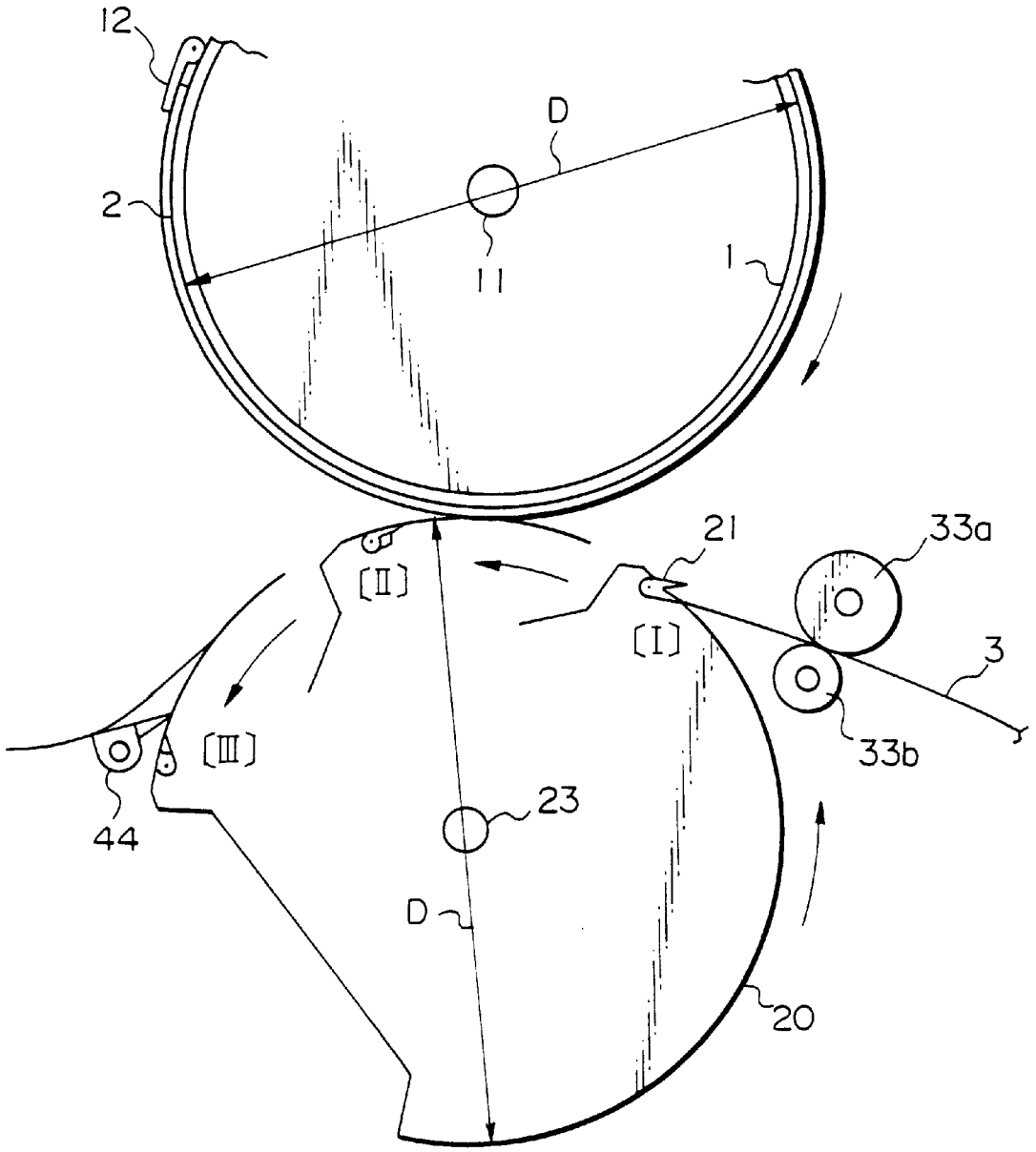
FIG. 2 is a front view showing consecutive angular positions of a sheet clamper occurring in the illustrative embodiment in accordance with the rotation of a press drum, and how a sheet is conveyed.

As shown in FIGS. 1 and 2, tho print drum 1 is made up of a porous hollow cylinder and a laminate of mesh screens, not shown, wrapped around the hallow cylinder. The print drum 1 is rotatably mounted on a tubular shift 11 and driven by a DC motor or similar main motor, not shown, via a drive transmission mechanism, not shown. In the illustrative embodiment, the rotation of the main motor is not transferred to a sheet feed drive mechanism, as will be described specifically later. This allows the main motor smaller in size than the conventional main motor to be used. A master clamper 12 is mounted on the outer periphery of the print drum 1 in order to clamp the leading, edge of the master 2 output from the master making device 19.

The master clamper 12 faces a stage, not shown, fixed on the print drum 1 and extending along a line parallel to the axis of the drum 1. The stage is formed of a ferromagnetic material. The master clamper 12 is rotatable toward and away from the stage and provided with a magnet on its surface facing the stage. When the print drum 1 is brought to a preselected angular position, an opening/closing device, not shown, causes the master clamper 12 to open or close.

The master making device 19 includes a support shaft 10*b*. The stencil 2 is wound round a core 10*a* in the form of a roll 10 and supported by the support shaft 10*a* such that it can be paid out from the roll 10. A platen roller 9 convoys the stencil 2. A thermal head 17 is movable into and out of contact with the platen roller 9. A pair of cutter members 4 are arranged one above the other at a position downstream of the platen roller 9 in the direction in which the stencil 2 is conveyed. Rollers 5*a* and 5*b* are provided in a pair for conveying the leading edge of the stencil 2 toward the master clamper 12.

The platen roller 9 has its shaft rotatably supported and is driven by a stepping motor 6 at a preselected peripheral speed. The platen roller 9 in rotation conveys the stencil 2 while pressing it against the thermal head 17. The thermal head 17 has a plurality of boating elements arranged in an array in the widthwise direction of the stencil 2. The head 17 is movable into and out of contact with the platen roller 9 by being driven by a conventional mechanism, not shown. A digital image signal representative of a document image is processed by am analog-to-digital converter and a master making controller included in a document reading section, not shown. The head 17 selectively perforates the stencil 2 in accordance with the digital image signal to thereby form in image in the stencil 2.

The upper cuter member 4 is moved up and down by an eccentric cam 8 in order to cut the stencil 2 at a preselected length The eccentric cam 8 is rotated by a cutter motor 7.

The ink feeding device 22 includes an ink roller 13 rotatable in synchronism with and in the same direction as the print drum 1 for feeding ink to the inner periphery of the print drum 1. A doctor roller 15 is positioned in parallel with the ink roller 13 and spaced from the roller 13 by a small gap, forming in ink well 16 between it and the roller 13. The ink is fed to the ink well 16 via the tubular shaft 11, The ink roller 13 and doctor roller 15 are journalled to opposite side walls, not shown, affixed to the tubular shaft 11. Because the print drum 1 and ink roller 13 are spaced by a small gap, the ink fed from the ink well 16 to the periphery of the roller 13 is transferred to the inner periphery of the print drum 1. An ink pack, not shown, is located at a suitable position. The ink is fed under pressure from the ink pack to the tubular shaft 11 by an ink pump, not shown, and dropped from the shaft 11 to the ink well 16 via holes formed in the shaft 11.

In the illustrative embodiment, the pressing means is implemented by die press drum 20 having the sheet clamper 21 and capable of enhancing the registration accuracy of the sheet 3, as stated in relation to the background art. As shown in FIG. 2, the press drum 20 has an outside diameter D equal to the outside diameter D of the print drum 1, so that the drum 20 completes one rotation at the same time as the drum 1. This allows the sheet clamper 21 to be mounted on the press drum 20. By feeding the sheet 3 while causing its leading edge to abut against the clamper 21, it is possible to enhance the registration accuracy of the sheet 3.

FIG. 2 shows various consecutive angular positions [I], [II] and [III] of the press drum 20. In the position [I] (sometimes referred to as a clamping position hereinafter), the sheet clamper 21 is closed for the leading edge of the sheet 3 has abutted against it. The clamper 21 clamping the sheet 3 is sequentially moved from the position [I] to the position [III] (sometimes referred to as an unclamping position hereafter) via the position [II]. In the position [III], the clamper 21 is opened so as to release the sheet 3. That is, the leading edge of the sheet 3 is released from the clamper 21 at a position past the position [II] where the ink is transferred to the sheet 3. This derives another advantage that the sheet 3 is prevented from wrapping around the print drum 1 due to the adhesion of the ink.

Figure 3:
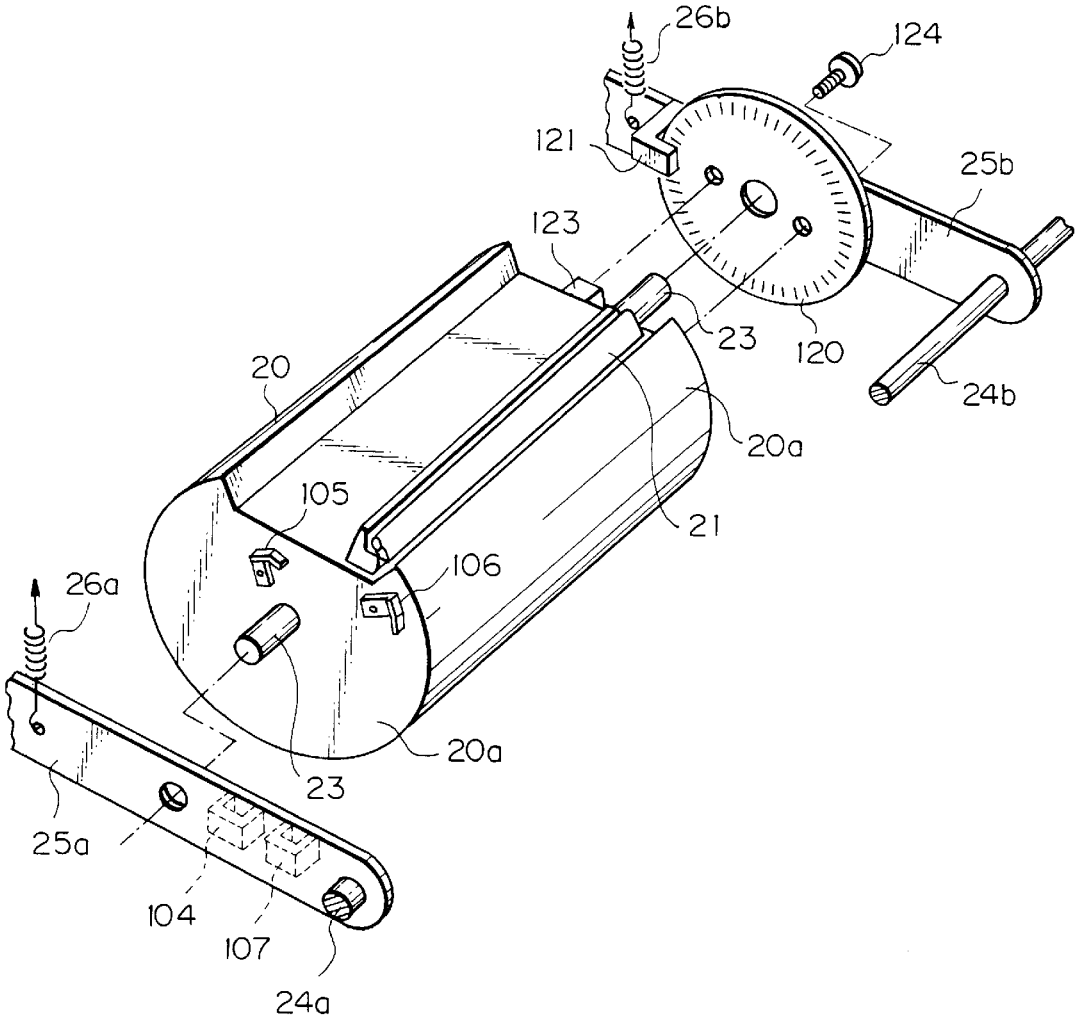
FIG. 3 is an exploded perspective view showing structural elements around a press drum included in the illustrative embodiment.

As shown in FIGS. 1 and 3, the press drum 20 has opposite end plates 20*a* (only one is visible) affixed to a shaft 23. A pair of arms 25*a* and 25*b* (only one is visible) are arranged on opposite ends of the press drum 20. The shaft 23 is journalled to the arms 25*a* and 25*b* via bearings, not shown, at opposite ends thereof In this configuration, the press drum 20 is rotatable via the shaft 23. A shaft or fulcrum 24*a* is mounted on one of opposite side walls, not shown, of the printer body and supports one end of the arm 25*a* via a bearing. One end of the other at 25*b* is supported by a shaft or fulcrum 24*b* rotatably supported by the other side wall via a bearing, not shown. The shafts 24*a* and 24*b* arm aligned with each other.

A drive gear, not shown, is mounted on the inner end of the shaft 24*b* in order to cause the press drum 20 to rotate. A driven gear, not shown, is mounted on the shaft 23 and held in mesh with the drive gear. A toothed pulley, not shown, is mounted on the outer end of the shaft 24*b* in order to transfer the rotation of the print drum 1. Another toothed pulley, not shown, is mounted on one end plate of the print drum 1. A toothed belt, not shown, is passed over these toothed pulleys. A pulley is mounted on the above end plate of the print drum 1 cordially with the toothed pulley mounted on the print drum 1. In this configuration, the rotation of the main motor is transmitted to the above pulley via a belt and then transmitted to the driven gear of the shaft 23 via the toothed belt passed over the toothed pulleys, and drive gear. As a result, the press drum 20 is rotated counterclockwise at the same peripheral speed as the print drum 1 such that it presses itself against the print drum 1 at the same position at all times.

The circumferential surface of the press drum 20 is made up of a cylindrical portion capable of contacting the print drum 1, and a generally D-shaped recess portion for preventing the press drum 20 from conflicting with the master clamper 12. The sheet clamp 21 is positioned in the recess portion of the press drum 20 and has one end thereof affixed to a shaft. A spring, not shown, constantly biases the sheet clamper 21 in the closing direction. A cam, not shown, causes the sheet clamper 21 to open and receive the leading edge of the sheet 3 at a preselected timing, and then close to clamp the sheet 3. As a result, the sheet 3 is retained on the periphery of the drum 20.

Moving means moves the press drum 20 into and out of contact with the print drum 1. The moving means is implemented mainly by the arms 25*a* and 25*b* stated earlier, a pair of cam followers, not shown, respectively rotatably supported by the other ends of the arms 25*a* and 25*b*, a pair of springs 26*a* and 26*b* respectively constantly biasing the arms 25*a* and 25*b* toward the print drum 1, and a pair of cams, not shown, respectively selectively contacting the cam followers.

The cams provided in a pair, as stated above, are connected to the print drum 1 and main motor by toothed belts, not shown, so as to rotate in synchronism with the print drum 1. The cams have such a profile that at the time of defective sheet transport or during master making operation, the cams slidingly contact the associated cam followers at a preselected timing in order to release the press drum 20 from the print drum 1, but in the other conditions they do not contact the cam followers in order to cause the press drum 20 clamping the sheet 3 to contact the print drum 1 under the action of the springs 26*e* and 26*b*. In this manner, the press drum 20 is angularly movable about the shafts 24*a* and 24*b* between the position whom it is pressed against the drum 1 and the position where it is spaced from the drum 1 in accordance with the rotation of the cams.

The springs 26*a* and 26*b* having the above function are respectively anchored to the arms 25*a* and 25*b*, so that the press drum 20 can be pressed evenly against the print drum 1.

When defective sheet transport occurs, a cancelling mechanism, not shown, cancels the bias acting on the press drum 20 in order to prevent the press drum 20 from moving into contact with the print drum 1.

The drive mechanism including the main motor and the moving mechanism may be implemented by mechanisms shown in FIGS. 1–5 of Laid-Open Publication No. 9-216448 mentioned earlier.

A master discharging device 18 is located at the left-hand aide of the print drum 1, as viewed in FIG. 1. The master discharging device 18 peels off and collects a used master 2 wrapped around the print drum 1.

The sheet discharging device 43 is identical with the conventional sheet discharging device 43', FIG. 13, except that a separator 44 for separating and guiding the sheet or printing 3 is substituted for the peeler 49. The device 43 has, in addition to the separator 44, a belt 48 passed over an inlet roller 46 and an outlet roller 47 for conveying the sheet 3 separated by the separator 44, and a suction fan, not shown.

The belt 48 is driven at a speed higher than the peripheral speed of the print drum 1 by a mechanism including a motor. A printing try 45 is positioned at the left-band side of the device 43, as viewed in FIG. 1, for stocking the sheets 3 sequentially driven out of the printer.

The sheet feeding device 29 is similar to the conventional sheet feeding device 29' accept for the following. The conventional sector gear scheme for driving the feed roller 32 is replaced with an independent drive system including an exclusive stepping motor 100 independent of the main motor. Also, the conventional sector gear scheme for driving the registration rollers 33*a* and 33*b* is replaced with an independent drive system including in exclusive stepping motor 102 independent of the main motor. Further, the conventional guide plates 38' am replaced with a pair of guide plum 38 which guide the leading edge of the sheet 3 to the sheet clamper 21 of the press drum 20.

In the illustrative embodiment, the registration rollers 33*a* and 33*b* drive the leading edge of the sheet 3 at a preselected timing toward the clamper 21 of the press drum 20 brought to the preselected angular position. The distance from the nip between the registration rollers 33*a* and 33*b* to the nip between the press drum 20 and the print drum 1 is maintained constant at all times.

The stepping motor 100 plays the role of feed roller drive means for causing the feed roller 32 to rotate. Specifically, a drive pulley is mounted on the output shaft of the stepping, motor 100. A toothed endless belt 101 is passed over the drive pulley and a driven pulley mounted on the shaft of the feed roller 32. The stepping motor 100 causes the fed roller 32 to rotate clockwise via the above driveline. A one-way clutch, not shown, is built in each of the shafts of the feed roller 32 and pick-up roller 30, allowing each of the rollers 32 and 30 to rotate only in the clockwise direction.

The stepping motor 102 serves as registration roller drive means for causing the lower registration roller 33*b* to rotate. Specifically, a toothed endless belt 103 is passed over a drive pulley mounted on the output shaft of the stepping motor 102 and a driven pulley mounted on the shaft of the registration roller 33*b*.

An electromagnetic clutch 122 is interposed between the above driven pulley and the lower registration roller 33*b* in order to selectively couple or uncouple the stopping motor 102 to or from the lower registration roller 33*b*. When the clutch 122 is turned on, the driven pulley is coupled to the lower registration roller 33*b* with the result that the rotation of the stepping motor 102 is transmitted to the roller 33*b*. This causes the registration roller 33*b* to rotate clockwise. When the clutch 122 is turned off, the driven pulley is uncoupled from the registration roller 33*b*, interrupting the drive transmission from the motor 102 to the roller 33*b*.

A sheet feed control system included in the illustrative embodiment will be described with reference to FIGS. 1–5. As shown in FIGS. 1 and 3, interrupter 105 and 106 are fastened to the outer surface of the front end plate 20*a* of the press drum 20 and spaced in each of the radial and circumferential directions of the press drum 20 by a preselected distance. The interrupters 105 and 106 each is formed of sheet metal or synthetic resin and generally L-shaped, as seen in a front view and a side elevation, such that its end protrudes toward the front.

Photosensors 104 and 107 are fastened to the inner surface of the arm 25*a* and spaced by a preselected distance in the radial direction of the press drum 20. The Photosensors 104 and 107 are conventional transmission type sensors each having a light emitting portion and a tight-sensitive portion.

The interrupter 105 and photosensor 104 are positioned such that the former interrupts the optical path of the latter only when the press drum 20 is rotated counterclockwise to a preselected position. The interrupter 105 and photosensor 104 play the role of sheet feed timing sensing means for causing the leading edge of the sheet 3 to be fed toward the registration rollers 33*a* and 33*b* at a preselected timing. The interrupter 105 is positioned on the end plate 20*a* of the press drum 20 such that when the trailing edge of a sheet 3 of size A3 moves away from the nip between the registration rollers 33*a* and 33*b*, the interrupter 105 meets the photosensor 104. In response to the resulting ON signal output from the photosensor 104, the stepping motor 100 is energized in order to rotate the feed roller 32. At this instant, the electromagnetic clutch 122 is held in its OFF state and prevents the registration roller 33*b* from rotating.

Likewise, the interrupter 106 and photosensor 107 are positioned such that the former interrupts the optical path of the latter only when the press drum 20 is rotated counterclockwise to a preselected position. The interrupter 106 and photosensor 107 serve as timing sensing means for causing the clutch 122 to be turned on and thereby causing the leading edge of the above sheet 3 to be fed toward the clamper 21 of the press drum 20 at a preselected timing. Assume the distance on the sheet transport path, labeled R, between the nip between the registration rollers 33*a* and 33*b* and the position where the leading edge of the sheet abuts against the sheet clamper 21, and the circumferential distance of the press drum 20 between the position where the interrupter 106 meets photosensor 107 and the sheet clamper 21 against which the leading edge of the sheet 3 has abutted. Since the interrupter 106 is positioned on the end plate 20*a* such that the above two distances coincide with each other, the amount of feed of the sheet 3 and the displacement of the circumference of the press drum 20 may be equalized. The clamper 21 therefore clamps the leading edge of the sheet 3 without fail.

Figure 4:
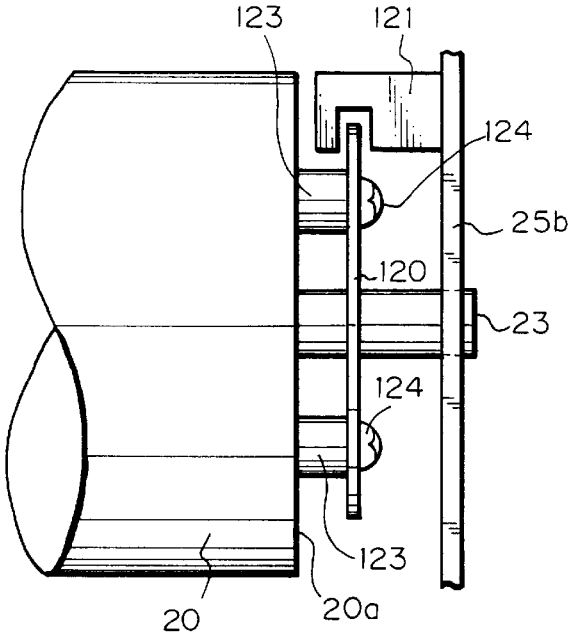
FIG. 4 is a fragmentary plan view of the arrangement shown in FIG. 3.

As shown in FIGS. 3 and 4, an coder 120 is fastened to the rear end plate 20*a* of the press drum 20 by screws 124 via two spacer 123. In the illustrative embodiment, the encoder 120 is implemented by a one-channel incremental type photoencoder formed with a number of radially extending slits in its peripheral portion. An encoder sensor 121 is fastened to the inner surface of the arm 25*b* adjoining the encoder 120 by screws or similar fastening means, and embraces the peripheral portion of the encoder 120. The encoder 120 and encoder sensor 121 play the role of a pulse encoder for sensing a change in the rotation speed of the press drum 20 and thereby controlling the time at which the leading edge of the sheet 3 should be driven toward the clamper 21. The displacement of the circumference of the press drum 20 corresponding to one pulse width of the encoder 120 is selected to be identical with the distance by which the stepping motor 102 feeds the sheet 3 with a single pulse.

Figure 5:
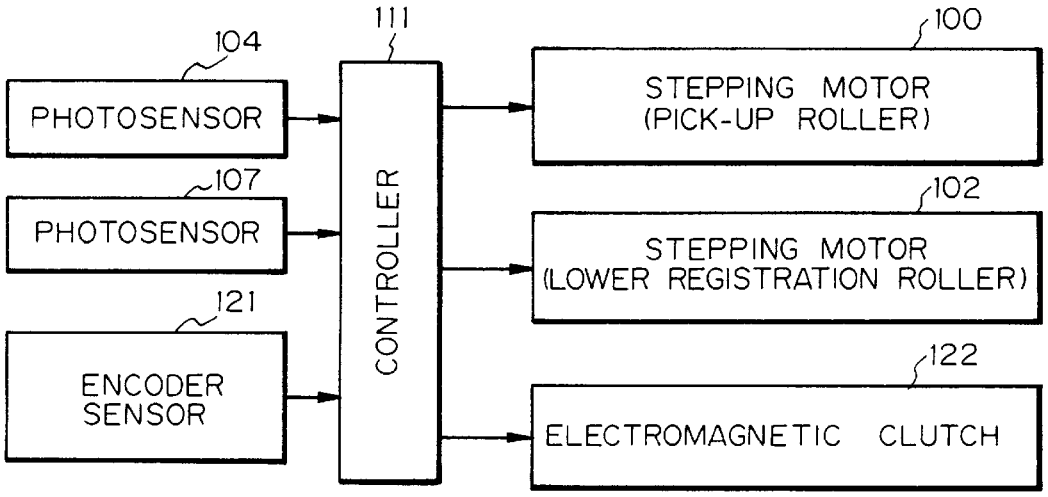
FIG. 5 is a block diagram schematically showing a sheet food control system included in the embodiment.

As shown in FIG. 5, the control system includes a controller 111 for controlling the sheet feed and implemented as a microcomputer, The microcomputer includes a CPU (Central Processing Unit), an I/O (Input/Output) port, a ROM (Road Only Memory), a RAM (Random Access Memory) and a timer connected together by a signal bus, although not shown specifically.

The CPU of the controller 111 (sometimes simply referred to as controller 111 hereinafter) is electrically connected to the stepping motor 102 via the output port. The controller 111 plays the role of registration roller drive control means for driving, in response to the output pulse signal of the encoder sensor 121, the stepping motor 102 such that the leading edge of the sheet 3 is so fed as to meet the clamper 21 brought to its clamping position.

Figure 6:
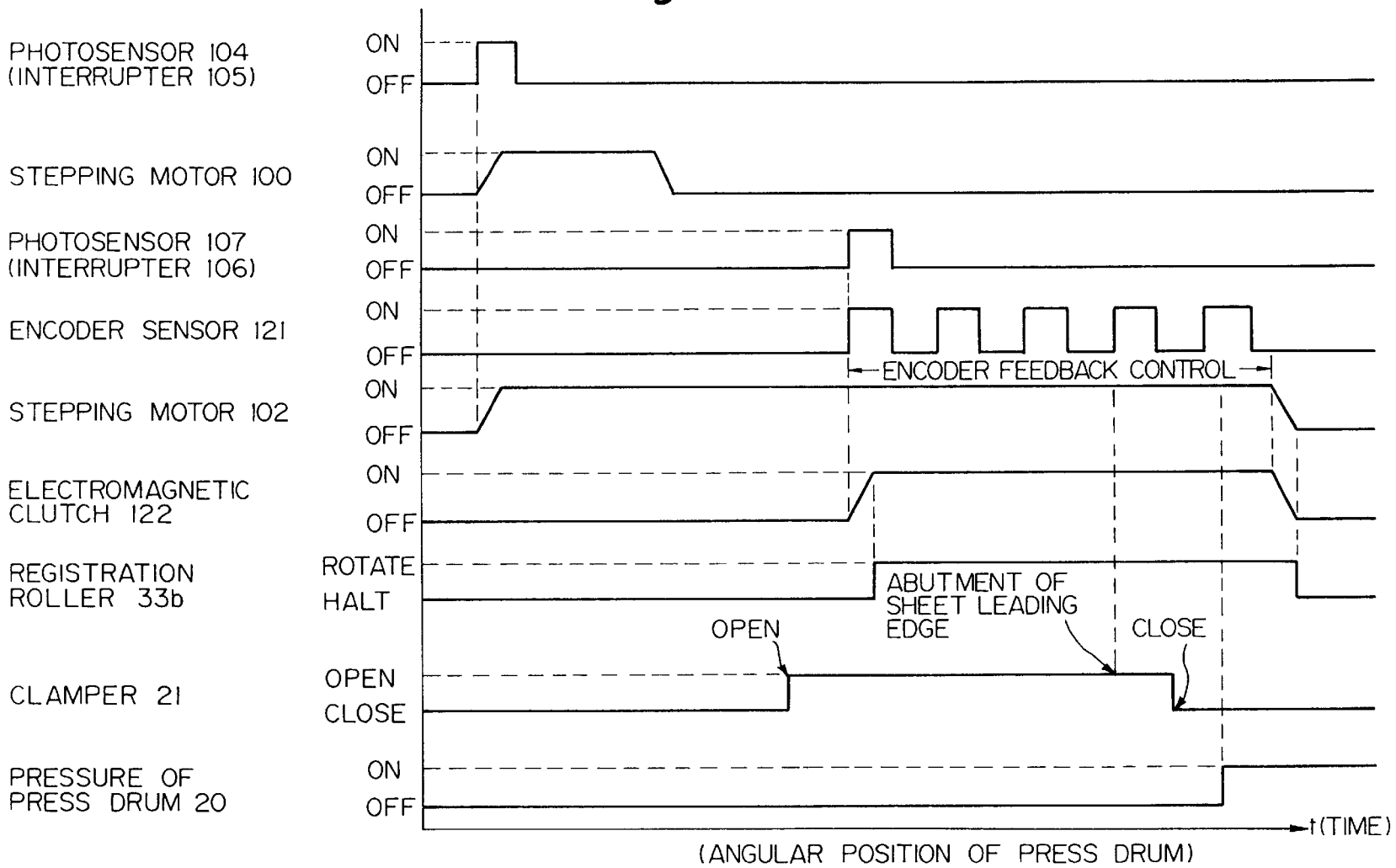
FIG. 6 is a timing chart demonstrating a sheet feed procedure particular to the embodiment.

A program representative of a procedure shown in FIG. 6 and determined beforehand by, e.g., experiments is stored in the ROM of the controller 111. Also, the ROM stores the constant distance from the nip between the registration rollers 33*a* and 33*b* to the nip between the press drum 20 and the print drum 1 in terms of the number of pulses of the stepping motor 102. The RAM of the controller 111 is used to temporarily store the results of calculations output from the CPU and to store the outputs of the photosensors 104 and 107 and encoder sensor 121, as needed.

The operation of the illustrative embodiment will be described hereinafter. The operator sets a document on the document reading section and then presses a start button, not shown. In response, the print drum 1 start rotating, and the master discharging device 18 peels off a used master wrapped around the print drum 1 and discards it. The print drum 1 is brought to a stop at its master feed position where the master clamper 12 is positioned at substantially the rightmost side of the print drum 1, as viewed in FIG. 1. Then, the shaft of the master clamper 12 is rotated in order to open the clamper 12 away from the stage. In this condition, the print drum 1 waits for the stencil or master 2.

Subsequently, the stepping motor 6 is energized with the result that the platen roller 9 start rotating while paying out the stencil 2 from the roll 10. In the document reading section, a scanner, not shown, sequentially scans the document while outputting an image signal. The image signal is processed by the previously mentioned analog-to-digital converter and master making controller to turn out a digital image signal. The heating elements of the terminal head 17 are selectively energized in accordance with the digital image signal, selectively perforating the stencil 2.

The platen roller 9 conveys the leading edge of the stencil 2 toward the master clamper 12 which is held in its open position. When the stepping motor 6 reaches a preselected number of steps, the shaft of the master clamper 12 is rotated to close the clamper 12. As a result, the leading edge of the performed part of the stencil or master 2 is clamped by the master clamper 12.

At the same time as the above clamping operation, the print drum 1 and press drum 20 each is caused to rotate at a peripheral speed substantially equal to the stencil conveying speed. Conscquently, the master 2 is sequentially wrapped around the print drum 1. When the master 2 is wrapped around the print drum 1 over a preselected length, the rotation of the print drum 1, press drum 20 and platen roller 9 is interrupted. At the same time, the cutter motor 7 is driven to lower the upper cutter member 4 via the eccentric cam 8, thereby cutting off the trailing edge of the master 2. Then, the print drum 1 is again rotated clockwise, pulling the trailing edge of the mater 2 out of the master making device 19. In this manner, the master 2 is fully wrapped around the print drum 1.

Figure 7:
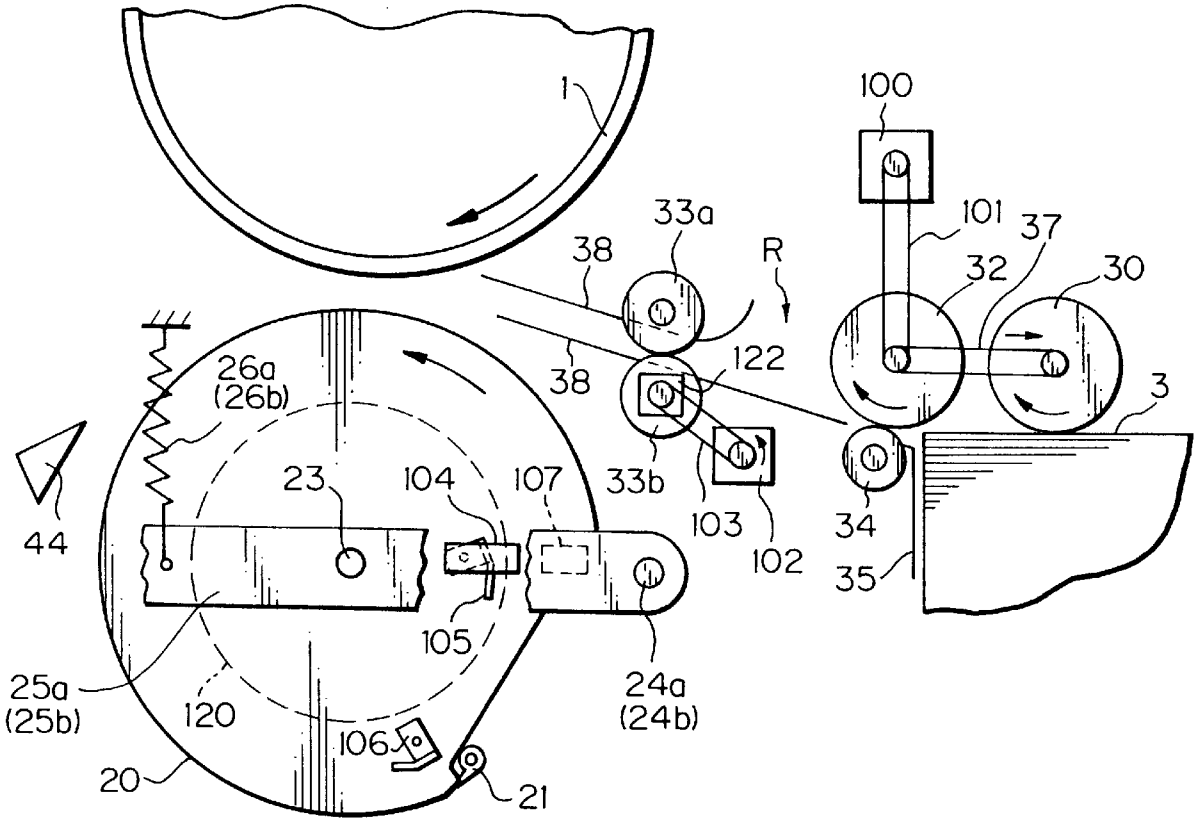
FIG. 7 is a front view showing how a feed roller included in the embodiment feeds a sheet just after it has been driven.
Figure 8:
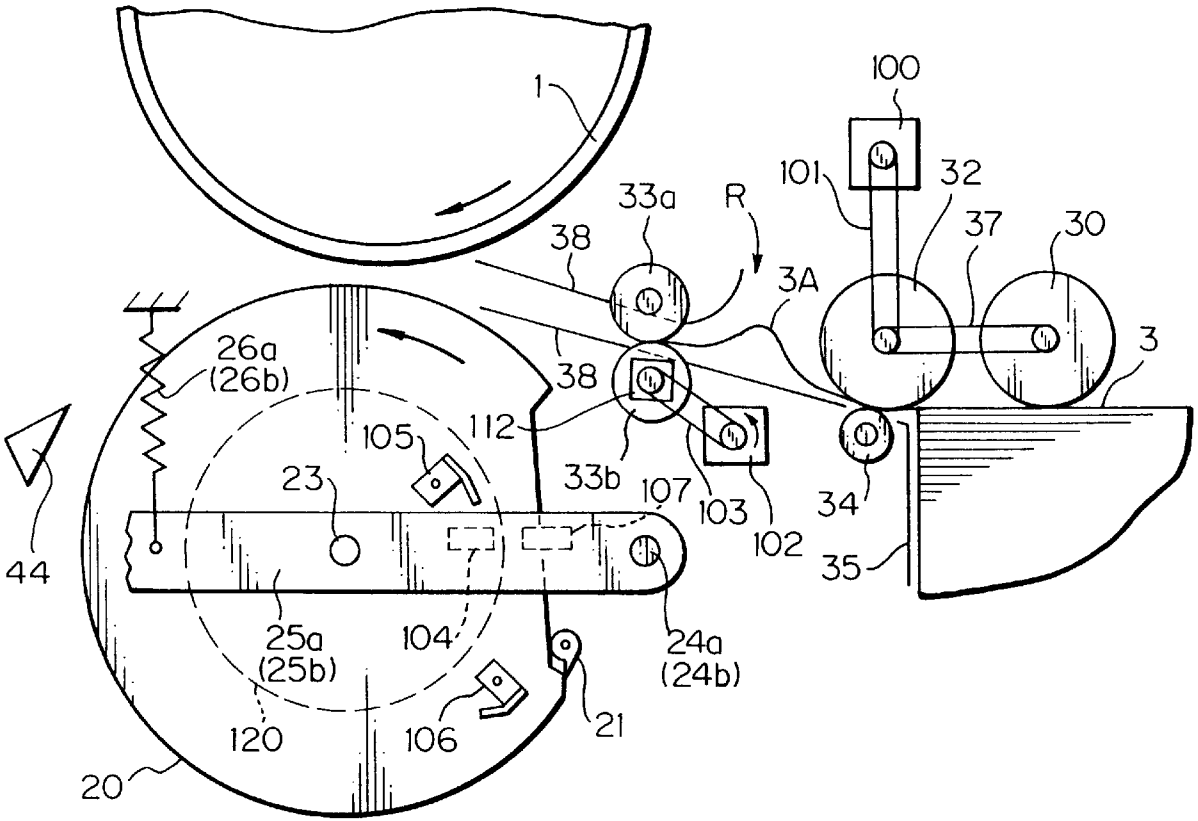
FIG. 8 is a front view showing how the embodiment causes the sheet to form a slack between the feed roller and a registration roller.

How the sheet 3 is conveyed will be described more specifically with reference to FIGS. 1–11. As shown in FIGS. 6 and 7, when the press drum 20 is rotated counterclockwise until the interrupter 105 meets the photosensor 104, the photosensor 104 sends its ON signal to the controller 111. In response, the controller 111 causes the stepping motor 100 to start rotating and thereby causes the feed roller 32 to rotate clockwise. At the same time, the pick-up roller 30 driven in the same direction as the feed roller 32 pays out the top sheet 3. The reverse roller 34 cooperates with the feed roller 32 to separate the top sheet 3 from the underlying sheets 3. The leading edge of the top sheet 3 abuts against the nip between the registration rollers 33*a* and 33*b*. As soon as the sheet 3 being further conveyed forms a preselected amount of sheet 3A upward, as shown in FIGS. 6 and 8, the rotation of the feed roller 32 and pick-up roller 30 is interrupted.

In the illustrative embodiment, the sheet 3 is fed by a distance which is 5 mm to 6 mm greater thin the distance between the nip between the registration rollers 33*a* and 33*b* and the front plate 35. The controller 111 converts such in amount of food to a number of steps and feeds a command representative of the number of steps to the stepping motor 100. As a result, the sheet 3 is fed by the feed roller 32 by a amount great enough to form the slack 3A.

When the interrupter 105 moves away from the photosensor 104, the stepping motor 102 begs to be rotated. However, the lower registration roller 33*b* does not rotate because the electromagnetic clutch 122 is held in its OFF position.

Figure 9:
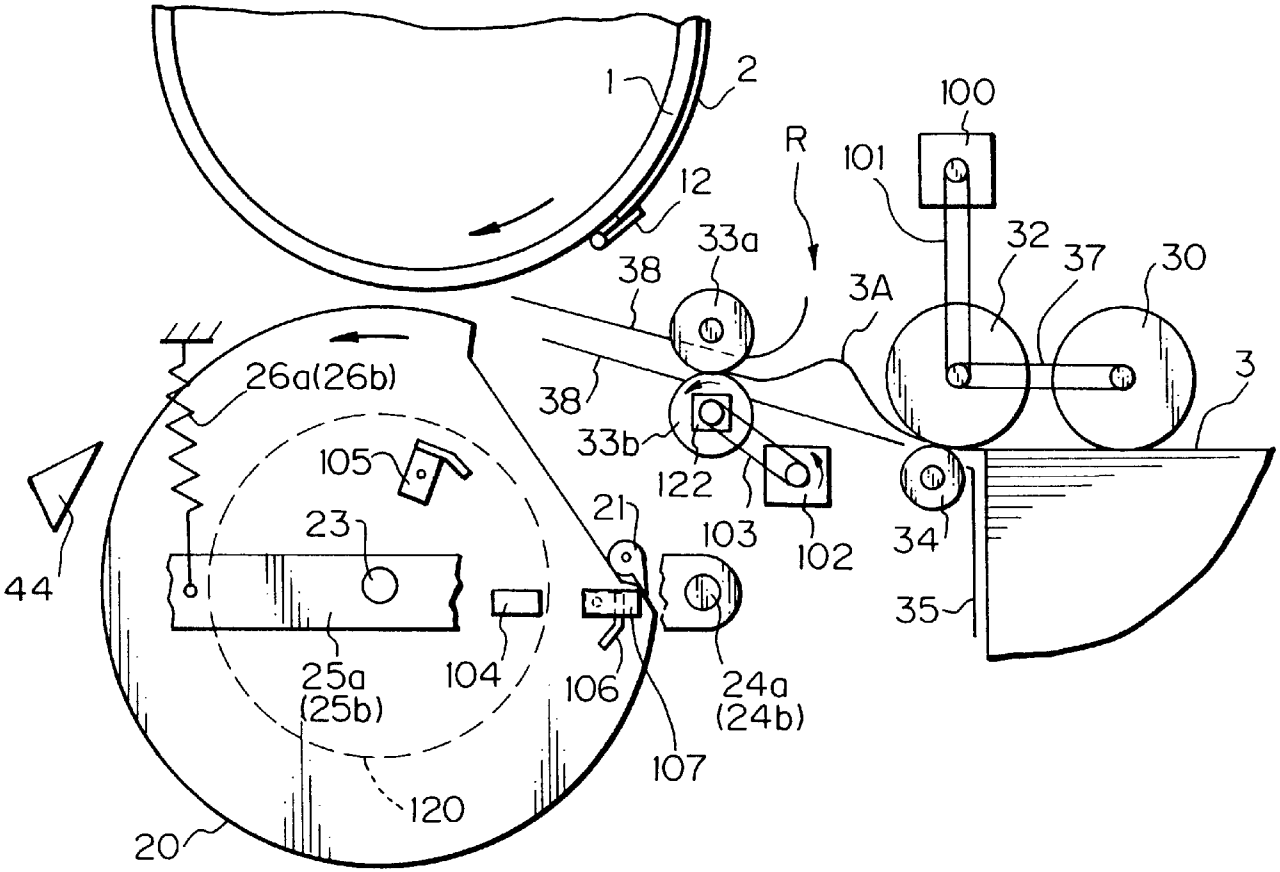
FIG. 9 is a front view showing how the registration roller conveys the sheet just after it has been driven.

As shown In FIGS. 6 and 9, while the press drum 20 is further rotated counterclockwise, the interrupter 106 meets the photosensor 107 and causes it to send an ON signal to the controller 11. In response, the cover 111 turns on the clutch 122. This, coupled with the rotation of the stepping motor 102, causes the registration roller 33*b* to rotate counterclockwise. The registration roller 33*b* therefore starts feeding the leading edge of the sheet 3 toward the clamper 21 of the press drum 20. Because the controller 111 drives the registration roller 33*b* at the same peripheral speed as the press drum 20 via the stepping motor 102, the roller 33*b* is rotated counterclockwise at the same peripheral speed as the press drum 20.

After the interrupter 106 has moved away from the photosensor 107, the controller 111 receiving the output pulses of the encoder sensor 121 drives the stepping motor 102 such that the leading edge of the sheet 3 meets the clamper 21 brought to its clamping position (feedback control).

The distance by which the stepping motor 102 feeds the sheet 3 with a single pulse is identical with the displacement of the circumference of the press drum 20 corresponding to a single pulse width of the encoder 120, as stated earlier. The controller 111 counts with its timer a first period of time necessary for the circumference of the press drum 20 to move in correspondence to a single pulse width of the encoder 120 affixed to the press drum 20, and determines a difference between the first period of time and a second period of time necessary for the stepping motor 102 to be rotated by a single pulse, When the second period of time is longer than the first period of time due to, e.g., a change in the load of the press drum 20, the controller 111 converts the difference between the two periods of time to a speed of the stepping motor 102 and accelerates the rotation of the stepping motor 102. When the second period of time is shorter than the first period of time, the controller 111 converts the difference between the two periods of time to a speed of the stepping motor and decelerates the rotation of the stepping motor 102. Stated another way, the controller 111 constantly traces variation in pulses output from the encoder sensor 121 and acribable to, e.g., changes in the load of the press drum 20, and variably controls the speed of the stepping motor 102 in accordance with the variation. In this manner, the controller 111 executes feedback control using a pulse encoder (Encoder Feedback Control shown in FIG. 6).

The encoder feedback control executed by the controller 111 equalizes the displacement of the circumference of the press drum 20 and the distance of conveyance of the sheet 3 occurring after the interrupter 106 has moved away from the photosensor 107.

Under the above encoder feedback control, the registration roller 33*b* is rotated counterclockwise, causing the upper registration roller 33*a* to rotate clockwise via the sheet 3. Consequently as shown in FIG. 10, the slack 3A of the sheet 3 (indicted by a dashed line) disappears. At this instant, the leading edge of the sheet 3 is conveyed toward the sheet clamper 21 of the press drum 20 with the feed roller 32 and pick-up roller 30 being rotated by the sheet 3.

Figure 10:
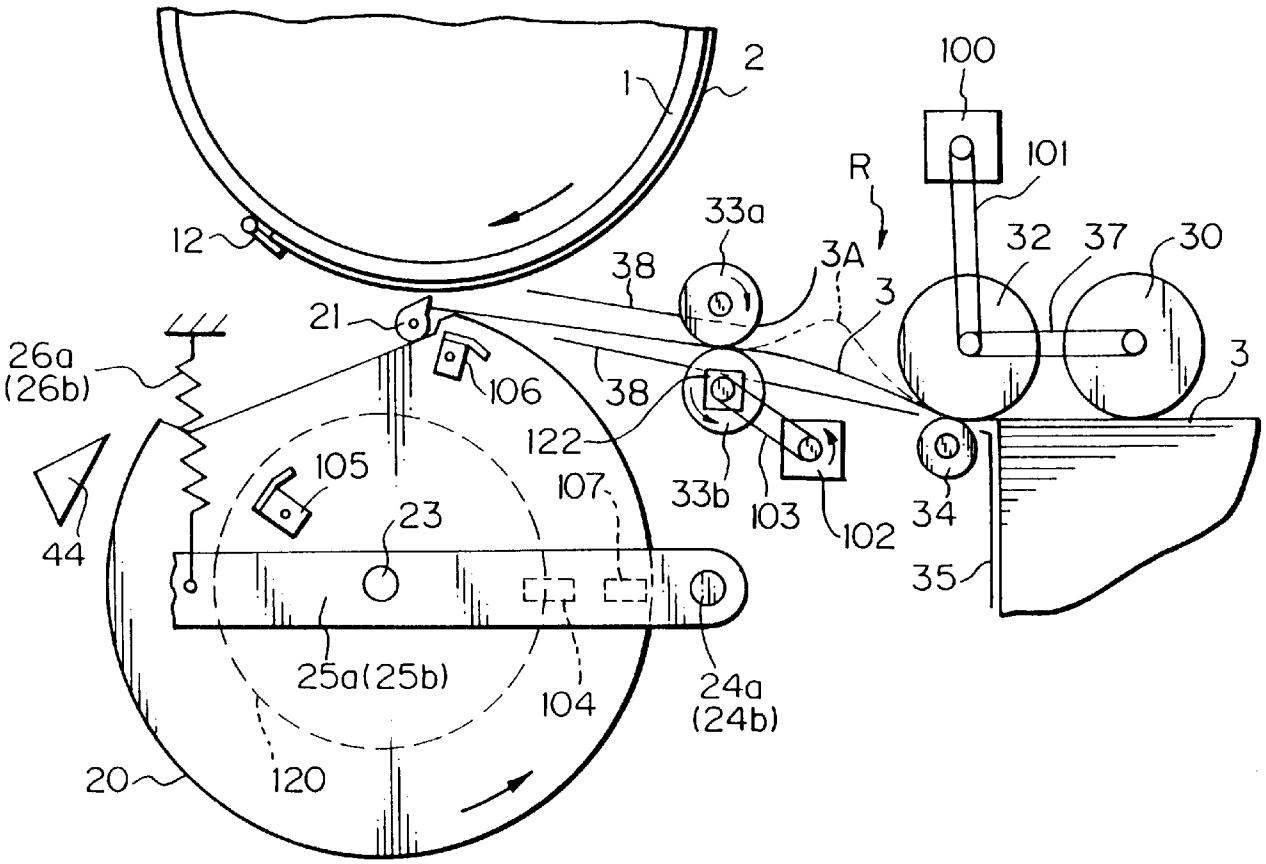
FIG. 10 is a front view demonstrating the transport of the leading edge of the sheet to the sheet clamper included in the embodiment.
Figure 11:
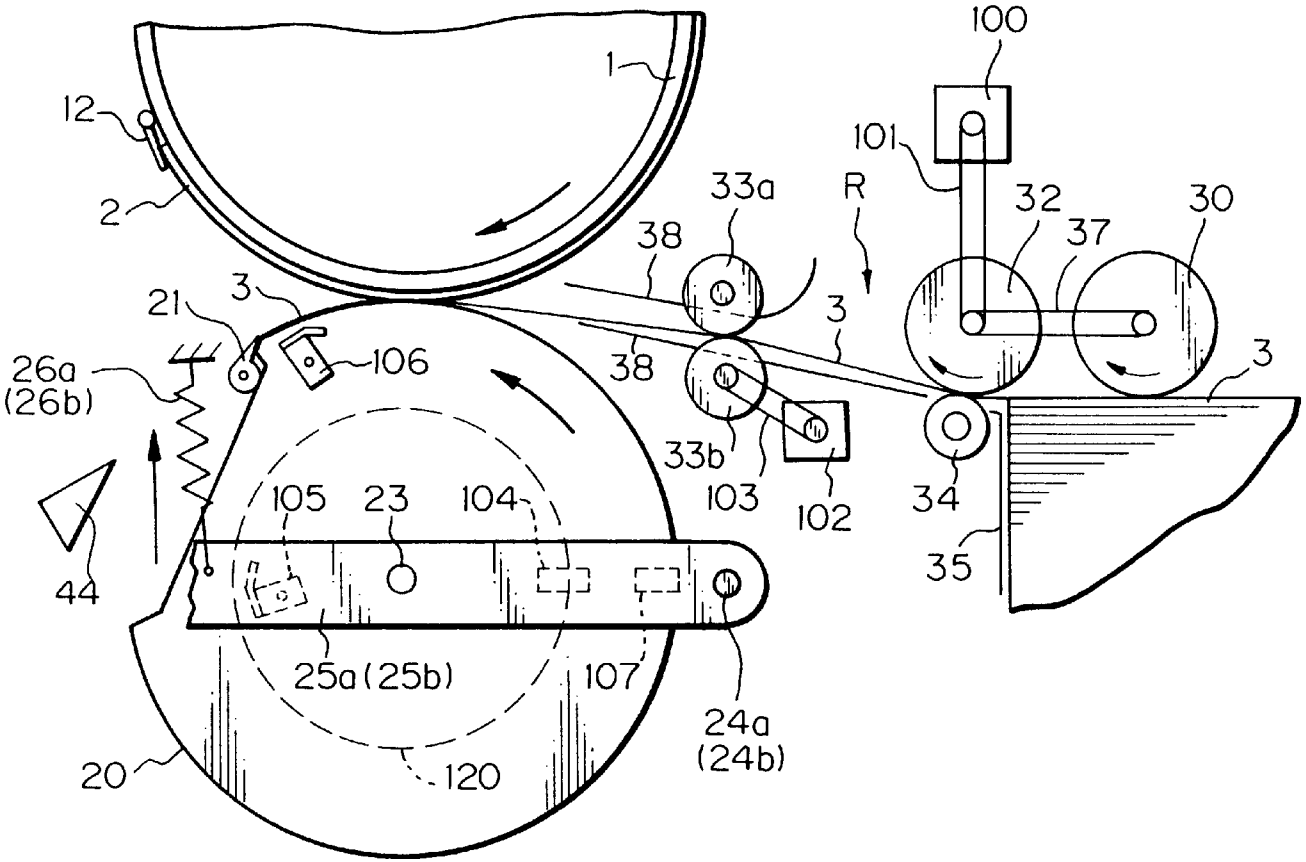
FIG. 11 is a front view showing the transport of the sheet occurring in the embodiment at the initial stage of printing operation.

As shown in FIGS. 6, 10 and 11, as soon as the leading edge of the sheet 3 abuts against the sheet clamper 21 held in its open position, the clamper 21 catches the sheet 3 and closes. The press drum 20 rotates while retaining the sheet 3 thereon and conveys the leading edge of the sheet 3 toward the gap between the drum 20 and the print drum 1. The interrupter 106 is positioned on the end plate 20*a* such that the two distances stated earlier coincide with each other. The controller 111 therefore sends a command signal to the stepping motor 102 in order to equalize the amount of feed of the sheet 3 and the displacement of the circumference of the press drum 20. The clamper 21 can therefore clamp the leading edge of the sheet 3 without fail.

As shown in FIG. 11, the pass drum 20 is moved upward by the springs 26*a* and 26*b* included in the moving means until it presses itself against the print drum 1 and forms a nip. As a result, the sheet 3 is processed against the print drum 1 by the press drum 20 (ON of Press Drum 20 shown in FIG. 6).

While the sheet 3 is sequentially pressed against the master 2 wrapped around the drum print 1 in rotation, the master 2 is brought into close contact with the drum 1. Consequently, the ink oozes out from the porous portion of the print drum 1 to the perforations of the master 2. The ink is transferred from the master 2 to the sheet 3, printing the document image on the sheet 3.

During the printing operation, the ink roller 13 is rotated in the same direction as the print drum 1. The ink in the ink well 16 is deposited on the ink roller 13 due to the rotation of the roller 13. The doctor roller 15 regulates the amount of the ink deposited on the ink roller 13. The ink is therefore fed to the inner periphery of the drum 1 in such a regulated amount.

Even in the above condition, the controller 111 continuously executes the pulse encoder feedback control, Assume that the controller 111 determines that the stepping motor 102 has been rotated by the number of pulses corresponding to the distance from the nip between the registration rollers 33*a* and 33*b* to the nip between the press drum 20 and the print drum 1 and stored in the ROM. Then, the controller 111 deenenergizes the stepping motor 102 and clutch 122 and ends the pulse encoder feedback control.

The sheet clamper 21 is opened when it is brought to a position short of the separator 44 by the press drum 20. The sheet 3 is separated from the press drum 20 by the separator 44 and then conveyed to the tray 45 by the belt 48 to turn out a trial printing. At the same time, the press drum 20 is released from the print drum 1, again setting up the initial condition.

The operator examines the trial printing so as to confirm the quality, position and other conditions of the image. If the trial printing is acceptable, the operator causes the printer to repeat the above sheet feeding, printing and sheet discharging steps a number of times corresponding to a desired number of printings.

The illustrative embodiment described above achieves the following various advantages. The pulse encoder (encoder 120 and encoder sensor 121) for sensing changes in the rotation speed of the drum 20 so as to allow the timing for feeding the leading edge of the sheet 3 toward the clamper 21 to be controlled is mounted on the press drum 20. This allows the sheet clamper 21 to surely clamp the leading edge of the sheet 3 and prevents the sheet 3 from rolling up. In addition, the sheet 3 can be fed stably and reliability and can therefore be brought into accurate registration.

The controller 111 controls, in response to the output pulse signal of the encoder sensor 121, the stepping motor 102 by feedback control such that the leading edge of the sheet 3 meets the camper 21 brought to its clamping position. The driveline for driving the registration rollers 33*a* and 33*b* is provided independently of the main motor used to drive the print drum 1 and press drum 20. This not only reduces the load on the drive system, but also promotes the use of a small capacity, inexpensive main motor.

The stepping motor 102 implemendng the registration roller drive means eliminates the need for mechanical parts for braking the registration roller and limiting the direction of rotation of the registration roller, and thereby reduces the cost. This simplifies the program of the controller and promotes rapid computation to thereby provide the feedback control with an accurate following capability.

Because the interrupter 106 and photosensor 107 for determining the timing for feeding the leading edge of the sheet 3 toward the clamper 21 art mounted on the press drum 20, the feed timing is stabilized and reliability is enhanced.

The interrupter 105 and photosensor 104 for determining the timing for the leading edge of the sheet 3 to be fed to the registration roller 33*a* and 33*b* are also arranged on the press drum 20. This also allows the sheet 3 to be fed stably and reliably.

The stepping motor 100 implementing the feed roller drive means eliminates the need for mechanical parts for limiting the direction of rotation of the feed roller, and thereby reduces the cost. The driveline for driving the feed rollers 32 and pick-up roller 30 is provided independently of the main motor used to drive the print drum 1 and press drum 20. This not only reduces the load on the drive system, but further promotes the use of a small capacity, inexpensive main motor.

Figure 12:
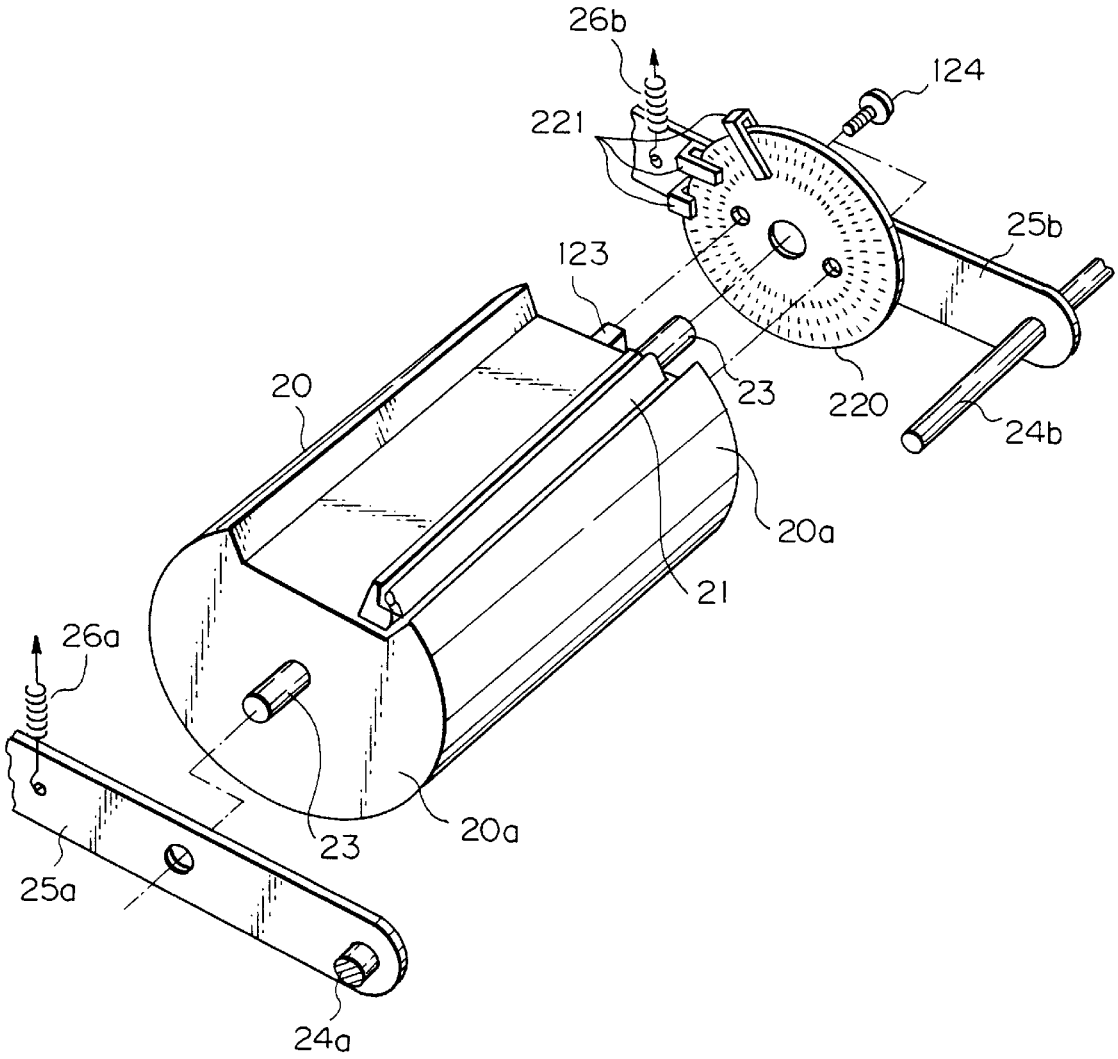
FIG. 12 is a front view showing a modification of the present invention.

A modification of the above embodiment will be described with reference made to FIGS. 1–11. As shown in FIG. 12, the modification differs from the illustrative embodiment in that an absolute type pulse encoder is substituted for the photosensor 104, interrupter 105, photosensor 107, interrupter 106, incremental type encoder 120 and encoder sensor 121. The absolute type pulse encoder is mounted on the press drum 20.

As shown in FIG. 12, the absolute type pulse encoder is made up of a multichannel photoencoder 220 and a plurality of encoder sensor 221. The photoencoder 220 is formed with a number of slits in a plurality of concentric steps in a peripheral portion thereof. The encoder sensors 221 are mounted on the arm 25*b*, and each embraces the peripheral portion of the photoencoder 220. Control achievable with the modification is identical with the control of the illustrative embodiment except that the functions of the photosensor 104, interrupter 105, photosensor 107, interrupter 106, incremental type encoder 120 and encoder sensor 121 are assigned to the absolute type pulse encoder.

The modification shown in FIG. 12 successfully reduces the number of parts while also achieving the various advantages stated earlier (the photoencoder 220 and encoder sensor 221 should be suitably substituted for the photosensor 104, interrupter 105, photosensor 107, interrupter 106, incremental encoder 120, and encoder sensor 121).

In the illustrative embodiment and its modification, the print drum 1 and press drum 20 art assumed to have the same outside diameter. The outside diameters, however, may not be exactly the same, but may include some tolerance in design. While the press drum 20 has been shown and described as being pressed against the print drum 1, the print drum 1 may be pressed against the press drum 20, or even both of the drums 1 and 20 may be pressed against each other. To press the print drum 1 against the press drum 20, the print drum 1 (or the ink roller 13 disposed in the drum 1) may be moved toward the press drum 20. When the press drum 20 is pressed against the print drum 1, the timing sensing means are arranged on the press drum 20 or a member movable substantially in synchronism with the drum 20 toward the drum 1. When the print drum 1 is pressed against the press drum 20, the timing sensing means are arranged on the press drum 20 or the portion of the printer body adjoining the drum 20. While the timing sensing means are implemented by transmission type or photointerrupter type photosensors and interrupters in the embodiment and its modification, use may be made of reflection type photosensors or microswitches with mechanical contacts if stable and reliable sensing is not of primary importance. The registration roller drive control means and feet roller drive control means way advantageously be implemented by a microcomputer or a microprocessor.

In summary, it will be seen that the present invention provides a press drum type printer having various unprecedented advantages, as follows. A sheet clamper is capable of surely clamping the leading edge of a sheet and preventing it from rolling up. The sheet can be fed toward the sheet clamper stably and reliably and can therefore be brought into accurate registration.

A driveline for driving registration rollers is provided independently of a main motor used to drive a print drum and pressing means (press drum or the like). This not only reduces a load to act on the drive system, but also promotes the use of a small capacity, inexpensive main motor.

Mechanical parts for braking registration rollers and limiting the direction of rotation of the roller are not necessary, so that the cost of the printer is reduced. A program to be executed by a controller is simplified while rapid computation is promoted, providing feedback control with an accurate following capability.

Timing sensing means for determining a timing for feeding the leading edge of a sheet toward the sheet clamper or registration roller and provided on the press drum enhances stable and reliable sheet feed.

Various modifications will become possible for those skilled in the art after receiving the teachings of the present disclosure without deputing from the scope thereof.

What is claimed is:

1. A printer for printing an image on a sheet by pressing the sheet against a master, comprising:

a print drum for wrapping the master therearound;

a press drum having substantially a same outside diameter as said print drum for pressing the sheet relatively against said print drum, said press drum including sheet clamping means for clamping a leading edge of the sheet; and a pulse encoder for sensing at least a change in a rotation speed of said press drum to thereby allow a timing for feeding a leading edge of the sheet toward said clamping means to be controlled.

2. A printer as claimed in claim 1, wherein said pulse encoder is mounted on said press drum.

3. A printer as claimed in claim 2, wherein said pulse encoder comprises a encoder mounted on said press drum and an encoder sensor adjoining said encoder, said printer further comprising:

a registration on roller for conveying the leading edge of the sheet toward said sheet clamping means;

registration roller drive means for causing said registration roller to rotate; and registration roller drive control means for driving, in response to a pulse signal output from said encoder sensor, said registration roller drive means to thereby feed the leading edge of the sheet in synchronism with an angular position of said clamping means.

4. A printer as claimed in claim 3, wherein said registration roller drive mean comprises a stepping motor, and wherein a displacement of a circumference of said press drum corresponding to a single pulse width of said pulse encoder is identical with a distance by which said stepping motor feeds the sheet with a single pulse.

5. A printer as claimed in claim 3, further comprising sheet feed timing sensing means mounted on said press drum for determining a timing for feeding the leading edge of the sheet toward said registration roller.

6. A printer as claimed in claim 1, further comprising timing sensing means mounted on said press drum for determining a timing for feeding the the leading edge of the sheet toward said clamping means.

7. A printer as claimed in claim 1, further comprising a registration roller for feeding the leading edge of the sheet toward said clamping means, and sheet feed timing sensing means for determining a timing for feeding the leading edge of the sheet toward said registration roller.

* * * * *

UNITED STATES PATENT AND TRADEMARK OFFICE

CERTIFICATE OF CORRECTION

PATENT NO. : 5,931,090

DATED : August 3, 1999

INVENTOR(S) : Eiji Ohkawa

It is certified that error appears in the above-indentified patent and that said Letters Patent is hereby corrected as shown below:

Column 1, line 15, change "an" to --and--

Column 3, line 10, change "arm" to --are--

Column 3, line 47, change "shoots" to --sheets--

Column 4, line 24, change "towers" to --lowers--

Column 4, lines 24-25, move the sentence "This lowers...street transport" to begin after "...sheet 3 is free." in line 23.

Column 5, line 8, change "thereat Therefore, ..." to --thereat. Therefore,...--

Column 5, line 37, change "mater" to --master--

Column 5, line 48, change "tho" to --the--

Column 5, Line 49, change "hallow" to --hollow--

Column 6, line 3, change "10a" to --10b--

Column 6, line 16, change "boating" to --heating--

UNITED STATES PATENT AND TRADEMARK OFFICE

CERTIFICATE OF CORRECTION

PATENT NO. : 5,931,090

DATED : August 3, 1999

INVENTOR(S) : Eiji Ohkawa

It is certified that error appears in the above-indentified patent and that said Letters Patent is hereby corrected as shown below:

Column 6, line 27, change "cuter" to --cutter--

Column 6, line 29, change "...length The..." to --...length. The...--

Column 6, line 35, change "in" to --an--

Column 6, line 36, change "...shaft 11, Because..." to --...shaft 11. Because...--

Column 7, line 9, change "...thereof In this..." to --...thereof. In this...--

Column 7, line 13, change "at" to --arm--

Column 7, line 27, change "cordially" to --coaxially--

Column 7, line 67, change "26*e*" to --26*a*--

Column 8, line 19, change "aide" to --side--

Column 8, lines 28-29, move the paragraph that begins "The belt 48 is driven..." to begin after "...not shown." in line 28

UNITED STATES PATENT AND TRADEMARK OFFICE

CERTIFICATE OF CORRECTION

PATENT NO. : 5,931,090

DATED : August 3, 1999

INVENTOR(S) : Eiji Ohkawa

It is certified that error appears in the above-indentified patent and that said Letters Patent is hereby corrected as shown below:

Column 8, line 31, change "try" to --tray--

Column 8, line 31, change "left-band" to --left-hand--

Column 8, line 32, change "stocking" to --stacking--

Column 8, line 43, change "am" to --are--

Column 8, line 44, change "plum" to --plates--

Column 8, line 59, change "fed" to --feed--

Column 9, line 17, change "interrupter" to --interrupters--

Column 9, line 29, change "tight-sensitive" to --light-sensitive--

Column 10, line 1, change "coder" to --encoder--

Column 10, line 3, change "spacer" to --spacers--

Column 10, line 47, change "start" to --starts--

UNITED STATES PATENT AND TRADEMARK OFFICE

CERTIFICATE OF CORRECTION

PATENT NO. : 5,931,090

DATED : August 3, 1999

INVENTOR(S) : Eiji Ohkawa

It is certified that error appears in the above-indentified patent and that said Letters Patent is hereby corrected as shown below:

Column 10, line 57, change "start" to --starts--

Column 11, line 17, change "mater" to --master--

Column 11, line 33, change "sheet" to --slack--

Column 11, line 37, change "thin" to --than--

Column 11, line 39, change "in" to --an--

Column 11, line 40, change "food" to --feed--

Column 11, line 43, change "a" to --an--

Column 11, line 45, change "begs" to --begins--

UNITED STATES PATENT AND TRADEMARK OFFICE

CERTIFICATE OF CORRECTION

PATENT NO. : 5,931,090

DATED : August 3, 1999

INVENTOR(S) : Eiji Ohkawa

It is certified that error appears in the above-indentified patent and that said Letters Patent is hereby corrected as shown below:

Column 12, line 11, change "...pulse, When..." to --...pulse. When...--

Column 13, line 59, change "art" to --are--

Column 16, line 2, change "a" to --an--

Column 16, line 5, delete "on"

Column 16, line 15, change "mean" to --means--

Column 16, line 27, change "the the" to --the--

Signed and Sealed this

Third Day of April, 2001

Nicholas P. Godici

*Attest:*

NICHOLAS P. GODICI

*Attesting Officer*

*Acting Director of the United States Patent and Trademark Office*